United States Patent [19]

Feest

[11] Patent Number: 4,674,554

[45] Date of Patent: Jun. 23, 1987

[54] METAL PRODUCT FABRICATION

[75] Inventor: Eric A. Feest, Didcot, England

[73] Assignee: United Kingdom Atomic Energy Authority, London, England

[21] Appl. No.: 843,721

[22] Filed: Mar. 25, 1986

[30] Foreign Application Priority Data

Mar. 25, 1985 [GB] United Kingdom ..... 8507675

[51] Int. Cl.[4] ..... B22D 23/00

[52] U.S. Cl. ..... 164/46; 164/97

[58] Field of Search ..... 164/46, 76.1, 97, 900

[56] References Cited

U.S. PATENT DOCUMENTS 3,826,301 7/1974 Brooks ..... 164/46

3,909,921 10/1975 Brooks ..... 164/46

3,951,651 4/1976 Mehrabian et al. ..... 164/900

4,473,103 9/1984 Kenney et al. ..... 164/900

*Primary Examiner*—M. Jordan

*Assistant Examiner*—Richard K. Seidel

*Attorney, Agent, or Firm*—Larson and Taylor

[57] ABSTRACT

A metal matrix composite (e.g. of SiC in a metal alloy) is made by the steps of atomizing a stream of molten metal to form a spray of hot metal particles by subjecting the stream to relatively cold gas directed at the stream, applying to the stream or spray relatively cold solid particles of a material of different composition from the metal, and depositing the metal having the particles incorporated therein. The deposit is made into a shaped metal matrix composite by reheating it to a controlled temperature substantially above the liquidus of the metal at which it flows under pressure and casting the fluid deposit to give the shaped product.

9 Claims, 3 Drawing Figures

METAL PRODUCT FABRICATION

Figure 1:
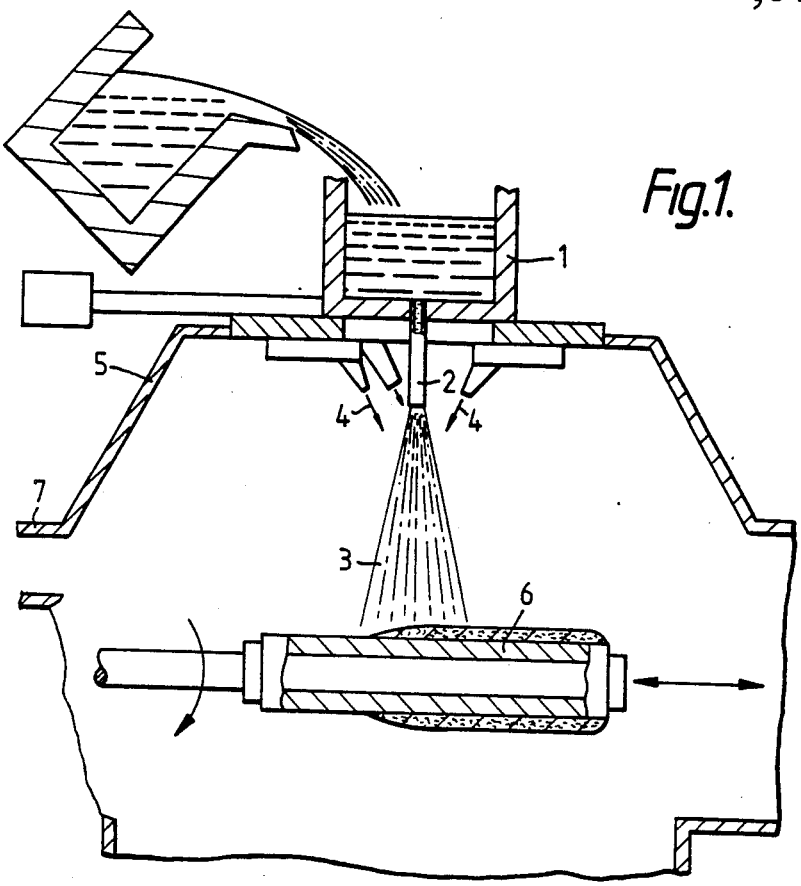

This invention relates to the manufacture of metal products in the form of shaped metal matrix composites.

Particulate composite materials wherein a particulate reinforcing material is carried in a metal matrix, frequently termed "metal matrix composites", are potentially useful industrial materials, for example where a combination of high strength and low density is required as in the motor vehicle and aerospace industries. One way of making metal matrix composites is by powder metallurgy, but this is an expensicve multi-stage process involving, for example, compaction of a powder mixture in a die unit followed by heat treatment and/or infiltration. A. R. E. Singer and S. Ozbek discuss the problems of producing metal matrix composites by this and other methods in "Metal Matrix Composites produced by Spray Co-Deposition", Paper 15 (1983) presented at the Powder Metallurgy Group Meeting of the Metals Society held in Edinburgh, UK from Oct. 24–26, 1983.

The above-mentioned paper describes the production of metal matrix composites by the incorporation of coarse particulate material (i.e. 75 micrometers to 120 micrometers) into metals by spray co-deposition. Spray co-deposition is itself described in UK Patent Specifications Nos. 1 379 261 and 1 472 939, a summary of each of which is given below.

UK Patent Specification No. 1 379 261 describes a method for manufacturing a shaped precision article from molten metal or molten metal alloy, comprising directing an atomised stream of molten metal or molten metal alloy onto a collecting surface to form a deposit, then directly working the deposit on the collecting surface by means of a die to form a precision metal or metal alloy article of a desired shape, and subsequently removing the precision shaped article from the collecting surface. The specification also describes an apparatus for manufacturing shaped precision articles from molten metal or molten metal alloy.

UK Patent Specification No. 1 472 939 describes a related process and in particular a method of manufacturing from liquid metal an individually shaped workable preform which is substantially non-particulate in nature, which is free from segregation, over 95% dense and possesses a substantially uniformly distributed, closed to atmosphere internal pore structure comprising the steps of atomising a stream of molten metal to form a spray of hot metal particles by subjecting the stream of molten metal to high velocity, relatively cold gas directed at the stream, directing the spray of particles into a shaped mould to form within the mould a discrete spray-deposited preform of desired dimensions, the temperature and flow rate of the gas being determined so as to extract a critical and controlled amount of heat from the atomised metal particles both during flight and on deposition, whereby the solidification of the preform is not dependant on the temperature and/or the thermal properties of the mould.

Each of the above-mentioned specifications states that, if desired, metallic and/or non-metallic powders, fibre, filaments or whiskers can be incorporated in the sprayed deposit during the deposition operation.

This invention is concerned with the production of metal matrix composites by the above-mentioned methods, followed by their subsequent processing to give shaped metal products. Thus, the invention provides a method of making a shaped metal matrix composite product comprising the steps of atomising a stream of molten metal to form a spray of hot metal particles by subjecting the stream to relatively cold gas directed at the stream, applying to the stream or spray solid particles of a material of different composition from the metal, depositing the metal having said particles incorporated therein, reheating the deposit to a controlled temperature above the solidus of the metal, the temperature being such that the deposit possesses sufficient fluidity for it to be gravity or pressure cast, and casting the fluid deposit to give a shaped product. The temperature is preferably above the liquidus of the metal, for example substantially above the liquidus.

The invention meets the problems of controlling the viscosity of the metal during the casting step and of possible agglomeration of the particles when the matrix becomes molten, and offers a simpler way of making shaped metal matrix composites products than powder metallurgy.

The invention may be used to prepare shaped metal matrix composites having uniformly dispersed therein a high volume percentage (e.g. in the range of 0.5–50%, typically 10–30%) of particles. The particles may be fine, e.g. less than 75 micrometers, such as less than 20 micrometers, preferably less than 10 micrometers, or they may be larger, e.g. in the range of 75–120 micrometers. The particulate material is for enhancing one or more physical properties of the metal matrix, e.g. for increasing the specific modulus of the material.

The metal used may be any elemental metal or alloy that can be melted and atomised and examples include aluminium, aluminium base alloys, steels, nickel base alloys, cobalt, copper and titanium base alloys. The fine, solid particles may be metallic or non-metallic and metallic and may be in various physical forms (such as a powder or chopped fibres) and sizes. Specific examples of such non-metallic particles are those of silicon carbide (e.g. having a particle size of less than 10 micrometers) and alumina. Silicon carbide in an aluminium alloy matrix can increase its specific modulus and possibly its high temperature strength.

In the embodiment of the invention where fine solid particles are used they are suitably applied by generating a fluidised bed thereof and feeding the particles from the bed into the molten metal stream or into the actual spray so that the deposited metal may have the particles evenly dispersed therein to form the metal matrix composite.

In the practice of the invention, the deposit may be tested for its suitability for casting by carrying out a simple fluidity test, for example by pouring through a 10 mm hold under a head of approximately 20 mm. If flow is satisfactory, casting may be carried out by methods such as those known in the art, for example by die casting under pressure or gravity or by chill casting.

Figure 2:
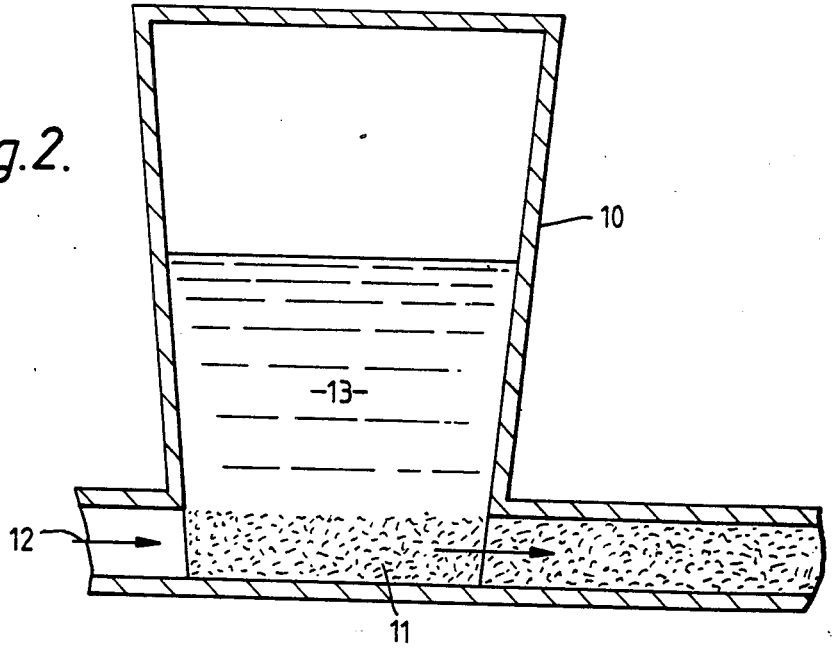
Figure 3:
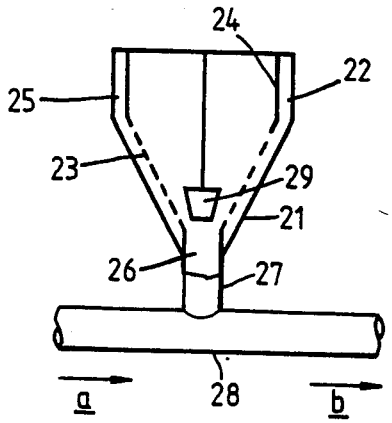

The invention will now be described by way of example with reference to the accompanying drawings in which FIG. 1 is a diagrammatic view of apparatus for carrying out the invention, FIG. 2 is a diagrammatic view of one form of injection apparatus, and FIG. 3 is a modification of the apparatus shown in FIG. 2.

In FIG. 1, apparatus for the formation of metal or metal alloy deposits comprises a tundish 1 in which metal is held above its liquidus temperature. The tundish 1 has a bottom opening so that the molten metal may issue in a stream 2 downwardly from the tundish 1 to be converted into a spray of particles by atomising gas jets 4 within a spray chamber 5, the spray chamber 5 first having been purged with inert gas so that the pick-up of oxygen is minimized. The sprayed particles are deposited upon a suitable collecting surface 6, in this case a mandrel to form a tubular deposit as will be explained.

In order to supply powder material to the injection nozzle 9, a reservoir 10 for powder is provided which is fluidised at the bottom 11 by the injection gas stream introduced at 12—see FIG. 2. IN this way the powder material 13 to be injected is both fluidised and carried to the injection nozzle 9 as desired by the same injection gas stream.

In FIG. 3 a more detailed alternative of fluidising apparatus is disclosed which comprises a closed outer fluidised bed container 21 having an inner container 22 consisting of a perforated conical lower portion 23 and an upper cylindrical portion 24. A passageway 25 for fluidising gas is defined between the outer container 21 and the inner container 22. The lower end of the inner container 22 has an exit orifice 26 communication via an exit pipe 27 with a conduit 28 for carrier gas. The orifice 26 is provided with a moveable plug 29 for controlling egress of material from the inner container 22.

The feed apparatus is connected to spray apparatus such as described in FIG. 1 thereof and is used for conveying the particulate material, thereto.

In operation of the overall apparatus and refering particularly to FIGS. 1 and 3 of the accompanying drawings, the inner container 22 is loaded with particulate material and fluidising gas is passed into the passageway 25, thence to enter the inner container 22 via its perforated lower portion 23 and generate a fluidised bed of the particulate material therein. Carrier gas is passed along the conduit 28 in the direction shown by the arrow a and the plug 29 adjusted to allow fluidised material to pass through the orifice 26, along the exit pipe 27 and into the conduit 28 to be conveyed therefrom by the carrier gas in the shown by the arrow b and thence into the spray chamber.

At the same time, a molten metal spray issues stream 2 from the tundish 1 into the spray chamber 5 and is atomised by gas issuing from the jets 4. Particulate material from conduit 28 is co-sprayed with the atomised stream and incorporated into the molten metal. A solidified deposit comprising a coherent deposit of a composite of the metal and a reinforcing material, is collected on the collecting surface 6.

In FIGS. 1 and 3, as indicated above, the spray 3 is directed on to a rotating mandrel collecting surface 6 to form a tubular spray deposit, the collecting surface, during formation of the deposit being moved so as to effect a reciprocating movement in accordance with the arrows in the figures or a slow-traverse through the spray. Once formed, the tubular deposit is removed from the collecting surface.

EXAMPLES

The invention is illustrated in the following examples:

The above-described apparatus was used to prepare samples of composite materials. The tundish was in the form of an induction heated, high alumina crucible and the spraying was carried out from a fixed jet. The collecting surface comprised a rotating tubular refractory substrate which was either oscillated along its axis or slowly traversed in one direction along its axis.

The general procedure was as follows.

Deposit Preparation

The crucible was loaded with a metal charge (3–4 Kg) of an Al alloy and its lid sealed to give controlled overpressure. The fluidised bed container was loaded with reinforcing material in the form of powder (particle size ≃9 micrometers, made by fusing and crushing fibres), and also sealed. The charge was melted by MF induction heating and after about 3 minutes the atomising gas was switched on. At about 3½ minutes, molten metal poured into the atomiser and formed a spray (flow rate 10 Kg/min); the fluidising gas was then passed to fluidise the reinforcing material (0.2–0.3 bar) which was injected into the atomising zone of the spray chamber (flow rate 2.5 Kg/min). A small overpressure of nitrogen was applied to the crucible and adjusted continuously to maintain a constant metal flow rate into the atomiser throughout the spraying period (20 seconds). A deposit of a composite material formed on the rotating substrate. The material was removed for examination after cooling and found to be very dense, substantially homogeneous with good wetting and adherence of the reinforcing material into the metal, and to contain about 20% by volume thereof.

Chill Casting

Deposit material prepared as above was melted and heated to 900° C. in a foundry crucible, allowed to cool to 870° C. and chill cast. The casting had satisfactory mould filling, dimensions, soundness and filler distribution for the following combinations of particles (reinforcing material) and metal (matrix material).

| Example | Metal (Matrix) | Particles (Filler) |
|---|---|---|
| 1 | LM13 | SiC |
| 2 | LM13 | $Al_2O_3$ |
| 3 | 6061 | SiC |
| 4 | 6061 | $Al_2O_3$ |

Key:
LM13 is an Al base alloy containing 13% by weight of Si and other additions;
6061 is an Al base alloy in wrought form containing relatively small proportions of Si, Cu, Zn, Mg and other additions and was used because it belongs to the class of low silicon alloys having good corrosion resistance.

Pressure Die Casting

A billet of the deposit, prepared as above and sufficient to make one casting with allowance for normal wastage, was melted and heated to 900° C. in a foundry crucible and allowed to cool to 870° C. The molten material was transferred to a preheated ladle and poured into the shot tube of a pressure diecasting machine. The machine was operated to give a thick section casting, i.e. thickness of the order of millimeters, which was found to be dimensionally satisfactory. Sections of the casting and the slug (the material attached to the runner but remaining in the shot tube) were examined microscopically. This showed that the distribution of the particles in the casting was superior to that in the original billet, and that the particles in the slug were segregated into strata across the direction of flow.

Castings were carried out for the same combinations of metal and particles as for the above-described chill casting procedure, i.e. Examples 1–4. In each case, satisfactory mould filling, dimensions, soundness, filler distribution and strength was achieved.

We claim:

1. A method of making a shaped metal matrix composite product comprising the steps of atomising a stream of molten metal to form a spray of hot metal particles by subjecting the stream to relatively cold gas directed at the stream, applying to the stream or spray solid non-metallic particles depositing the metal having said particles incorporated therein, reheating the deposit to a temperature above the solidus of the metal, the temperature being such that the deposit possesses sufficient fluidity for it to be gravity or pressure cast, and casting the fluid deposit to give a shaped product.

2. A method according to claim 1 wherein the temperature is above the liquidus of the metal.

3. A method according to claim 1 wherein the metal is aluminium, an aluminium base alloy, a steel, a nickel base alloy, cobalt, copper or a titanium base alloy.

4. A method according to claim 1 wherein the composite product has from 0.5% to 50% by volume of particles uniformly dispersed therein.

5. A method according to claim 4 wherein the composite product has from 10% to 30% by volume of particles uniformly dispersed therein.

6. A method according to claim 1 wherein the size of the particles is less than 20 micrometers.

7. A method according to claim 1 wherein the particles are non-metallic.

8. A method according to claim 7 wherein the particles are of silicon carbide or of alumina.

9. A method according to claim 8 wherein the particles are of silicon carbide having a particle size of less than 10 micrometers and the metal is an aluminium base alloy.

* * * * *